US008231356B2

(12) United States Patent
Matsutani et al.

(10) Patent No.: US 8,231,356 B2
(45) Date of Patent: Jul. 31, 2012

(54) CONTROL SYSTEM AND CONTROL METHOD FOR ELECTRIC WATER PUMP

(75) Inventors: Takashi Matsutani, Toyota (JP); Koichi Aizawa, Anjo (JP)

(73) Assignees: Toyota Jidosha Kabushiki Kaisha, Toyota-shi (JP); Aisin Seiki Kabushiki Kaisha, Kariya-Shi (JP)

( * ) Notice: Subject to any disclaimer, the term of this patent is extended or adjusted under 35 U.S.C. 154(b) by 566 days.

(21) Appl. No.: 12/430,320

(22) Filed: Apr. 27, 2009

(65) Prior Publication Data

US 2009/0269211 A1 Oct. 29, 2009

(30) Foreign Application Priority Data

Apr. 25, 2008 (JP) ..... 2008-115942

(51) Int. Cl.
*F04B 49/06* (2006.01)

(52) U.S. Cl. ..... 417/44.1

(58) Field of Classification Search ..... 417/44.1
See application file for complete search history.

(56) References Cited

U.S. PATENT DOCUMENTS

| | | | | |
|---|---|---|---|---|
| 5,019,756 | A * | 5/1991 | Schwarz | 318/400.21 |
| 6,211,635 | B1 | 4/2001 | Kambe et al. | |
| 2008/0007116 | A1* | 1/2008 | Takahashi et al. | 303/113.3 |
| 2009/0256507 | A1* | 10/2009 | Thompson et al. | 318/400.13 |

FOREIGN PATENT DOCUMENTS

| | | | |
|---|---|---|---|
| JP | 07245983 | A | 9/1995 |
| JP | 08266088 | A | 10/1996 |
| JP | 2000125584 | A | 4/2000 |
| JP | 2001113082 | | 4/2001 |
| JP | 2002161748 | | 6/2002 |
| JP | 2005009338 | A | 1/2005 |
| JP | 2005057922 | A | 3/2005 |
| JP | 2005065355 | A | 3/2005 |
| JP | 2008029122 | A | 2/2008 |
| WO | WO 2006075795 | A1 * | 7/2006 |
| WO | WO-2007125967 | A1 | 11/2007 |

* cited by examiner

*Primary Examiner* — Karabi Guharay
*Assistant Examiner* — Michael Santonocito
(74) *Attorney, Agent, or Firm* — Gifford, Krass, Sprinkle, Anderson & Citkowski, P.C.

(57) ABSTRACT

A control system is provided with an electric water pump that has a sensorless-type brushless motor including a rotor that rotates so as to circulate a coolant between an internal combustion engine and a radiator, and a control device that issues an instruction to stop the brushless motor and prohibits a start of the brushless motor till the rotor stops rotating.

15 Claims, 7 Drawing Sheets

CONTROL SYSTEM AND CONTROL METHOD FOR ELECTRIC WATER PUMP

INCORPORATION BY REFERENCE

The disclosure of Japanese Patent Application No. 2008-115942 filed on Apr. 25, 2008 including the specification, drawings and abstract is incorporated herein by reference in its entirety.

BACKGROUND OF THE INVENTION

1. Field of the Invention

The invention relates to a control system and a control method for an electric water pump for use in a cooling system of an internal combustion engine.

2. Description of the Related Art

In a cooling system of an internal combustion engine, a water pump typically circulates a coolant between the internal combustion engine and a radiator. The water pump can be of an internal combustion engine drive type or a motor drive type (electric water pump).

In a water pump of an internal combustion engine drive type, rotation power of a crankshaft of the internal combustion engine is transmitted by a belt to drive the water pump. An electric water pump is typically driven directly by a brushless motor that has a small friction loss.

The related art of cooling systems for internal combustion engines using an electric water pump will be described below.

For example, Japanese Patent Application Publication No. 2002-161748 (JP-A-2002-161748) discloses a cooling system for an internal combustion engine in which drive and stop of an electric water pump are controlled so that a coolant is maintained at a predetermined target temperature.

In this cooling system, when the coolant temperature is equal to or lower than a predetermined value, the brushless motor of the electric water pump is stopped or decelerated, and when the coolant temperature is equal to or above a predetermined value, the brushless motor is driven or accelerated.

In the related art disclosed in JP-A-2002-161748, hunting control is sometimes performed by which drive and stop of the electric water pump are frequently repeated in the vicinity of the target temperature of the coolant, but such a hunting control is easy to perform in a case where the brushless motor of the electric water pump is provided with a sensor for detecting a magnet position of the brushless motor rotor.

However, in recent years, the sensors are sometimes eliminated to make the brushless motors less expensive and more compact. Thus, in a case of a three-phase brushless motor, three magnetic sensors are necessary to know the position (angle) of the rotor for every 60 degrees.

In a case where such a sensorless-type brushless motor is used, when a control system issues a restart instruction in a state in which the rotor rotates by inertia after a stop instruction has been received, as in a mode in which the drive and stop are frequently repeated, the brushless motor synchronism is lost and the rotor is stopped because the rotor magnet position cannot be recognized. As a result, the restart has to be performed after the rotor has been stopped. Therefore, stable regulation of coolant temperature cannot be performed, for example, a time lag from when the stop instruction is outputted till when the restart is actually performed increases. Here, sufficient latitude for improvement opportunity is present.

JP-A-2002-161748 does not describe whether the brushless motor of the electric water pump is provided with a sensor for rotor angle detection, but because no special control is described to be performed when the brushless motor is started and stopped, it can be assumed that this related art requires the use of the sensors.

Japanese Patent Application Publication No. 2000-125584 (JP-A-2000-125584) and Japanese Patent Application Publication No. 2001-113082 (JP-A-2001-113082) (these documents relate to a field different from that of cooling systems for internal combustion engines) describe machines (an air conditioner and a washing machine) using a brushless motor that are provided with a magnetic sensor (Hall sensor) for detecting a position (angle) of the brushless motor rotor. Thus, it can be said that using a sensor for rotor angle detection is typical for control performed to drive and stop a brushless motor.

SUMMARY OF THE INVENTION

The invention provides a control system for a water pump and a control method for a water pump having a sensorless-type brushless motor in which loss of brushless motor synchronism can be avoided when a restarting condition is fulfilled during inertial rotation from when the instruction to stop the brushless motor is outputted till when the rotor stops rotating.

The first aspect of the invention relates to a control system including an electric water pump that has a sensorless-type brushless motor including a rotor that rotates so as to circulate a coolant between an internal combustion engine and a radiator; and a control device that issues an instruction to stop the brushless motor and prohibits a start of the brushless motor from when the stop instruction is outputted till when the rotor stops rotating.

With such a configuration, a restart processing is not executed till when the rotor stops rotating, even if the restarting condition is fulfilled while the rotor of the sensorless-type brushless motor provided in the electric water pump rotates by inertia. As a result, loss of synchronization in the brushless motor is suppressed.

The second aspect of the invention relates to a method for controlling an electric water pump that has a sensorless-type brushless motor including a rotor that rotates so as to circulate a coolant between an internal combustion engine and a radiator. The control method includes: stopping the brushless motor; estimating a time, during which the rotor rotates by inertia, on the basis of a rotation speed of the rotor when the brushless motor is stopped; and prohibiting a start of the brushless motor from when the brushless motor is stopped till when the estimated time, during which the rotor rotates by inertia, elapses.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
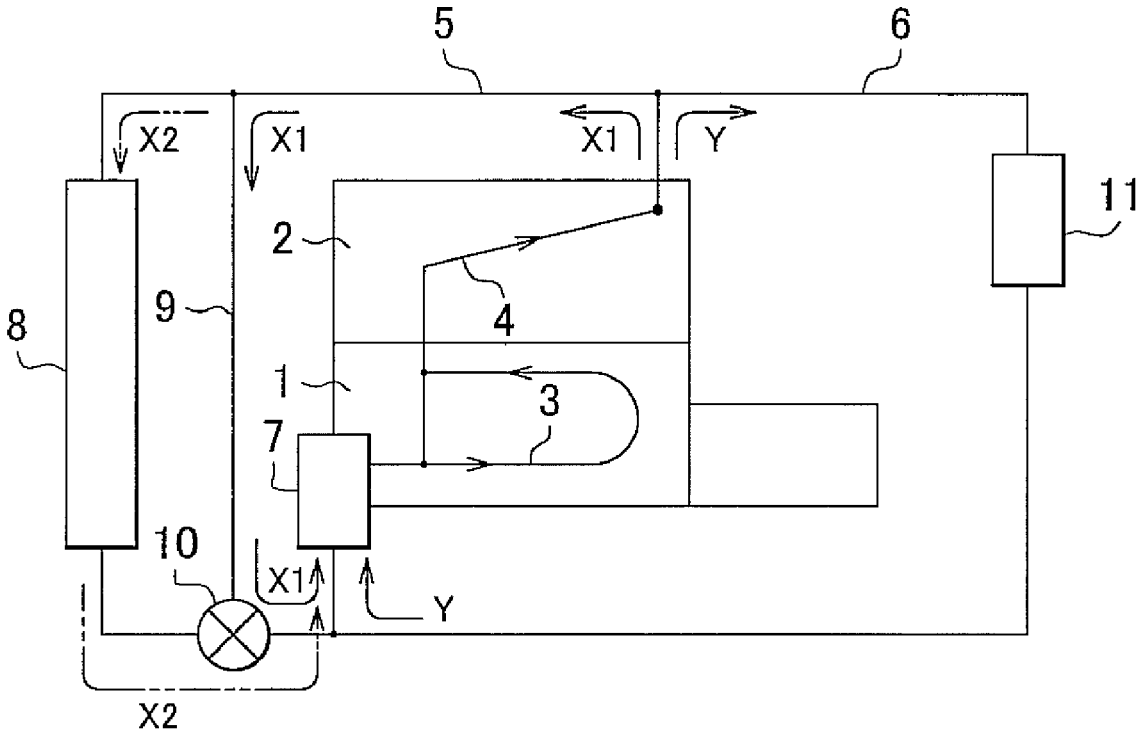
FIG. 1 is a schematic structural diagram illustrating a cooling system of an internal combustion engine of one embodiment of the invention.

Embodiments of the invention will be described below with reference to the appended drawings. One embodiment of the invention is illustrated by FIGS. 1 to 4.

A schematic configuration of a cooling system of an internal combustion engine will be described below with reference to FIG. 1. The cooling system is mainly configured so as to bring rapidly the temperature of a coolant used in the internal combustion engine to a predetermined set temperature and to maintain the coolant temperature within the predetermined set temperature range.

A coolant circulation circuit in the form of a closed loop is provided inside and outside the internal combustion engine. The coolant is circulated by a water pump 7 in the circulation circuit. The coolant is, for example, an antifreeze that is called a Long Life Coolant (LLC), as in a conventional system.

This coolant circulation circuit includes an internal passage provided inside the internal combustion engine and an external passage provided outside the internal combustion engine.

The internal passage mainly includes a water jacket 3 provided in a cylinder block 1 of the internal combustion engine and a water jacket 4 provided in a cylinder head 2 of the internal combustion engine.

The external passage mainly includes a radiator passage 5 and a heater passage 6 provided from the downstream portion of the water jacket 4 of the cylinder head 2 to the upstream portion of the water jacket 3 of the cylinder block 1 (inlet port of a water pump 7).

The coolant discharged from the water pump 7 is supplied to the water jacket 3 of the cylinder block 1 and the water jacket 4 of the cylinder head 2.

In other works, the passage on the downstream side of the water pump 7 is branched to two passages. One of these two passages is linked and coupled to the upstream portion of the water jacket 3 of the cylinder block 1, and the other passage is linked and coupled to the upstream portion of the water jacket 4 of the cylinder head 2.

The zone downstream of the water jacket 3 of the cylinder block 1 is linked to a passage leading from the water pump 7 to the water cylinder 4 of the cylinder head 2.

A radiator 8 is provided in the intermediate portion of the radiator passage 5. The radiator 8 dissipates heat of the coolant discharged from the water jacket 4 of the cylinder head to the radiator passage 5 and cools the coolant.

A bypass passage 9 is provided in the radiator passage 5. The bypass passage 9 serves to perform short circuit connection of the upstream side and downstream side of the radiator 8 so that no coolant passes through the radiator 8.

Furthermore, a thermostat 10 for switching the flow paths of the coolant is provided in the connection site of the bypass passage 9 and the downstream side of the radiator passage 5.

The thermostat 10 typically has a conventional configuration, for example, such that a valve body is driven by using as a drive source a thermowax that expands and shrinks correspondingly to the coolant temperature.

As an operation example of the thermostat 10, where the coolant temperature is less than a predetermined temperature, a warm-up path is ensured through which the coolant discharged from the water jacket 4 of the cylinder head is caused to pass to the bypass passage 9, without passing into the radiator 8, as shown by a solid arrow X1 in FIG. 1, whereas when the coolant temperature becomes equal to or higher than the predetermined temperature, a cooling path is ensured through which the coolant discharged from the water jacket 4 of the cylinder head is caused to pass to the radiator 8, as shown by a two-dot-dash arrow X2 in FIG. 1.

Furthermore, a heater core 11 serving as a heat source for warming the inside of a vehicle cabin is installed in the heater passage 6. The heater core 11 is provided close to the water jacket 4 of the cylinder head in the heater passage 6, recovers the heat of the high-temperature coolant discharged from the water jacket 4 of the cylinder head, and dissipates the recovered heat inside the vehicle cabin. The coolant flows through the heater passage 6 at all times as shown by a solid arrow Y in FIG. 1.

A portion using specific features of the invention will be described below in greater detail with reference to FIGS. 2 to 4.

First, the water pump 7 for use in the above-described cooling system is implemented as an electric water pump and the operation of this electric water pump 7 is controlled by a control device 20.

Figure 2:
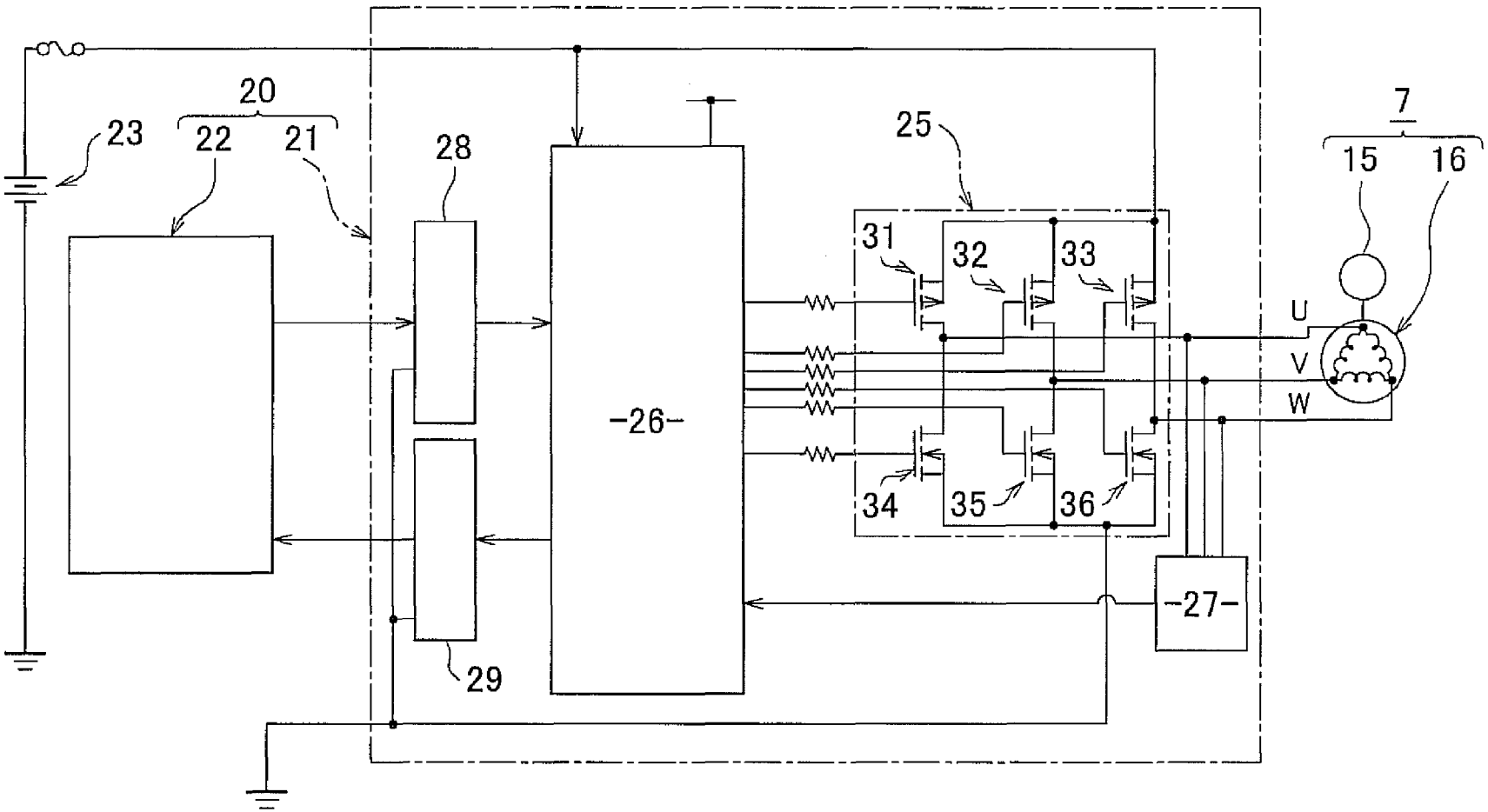
FIG. 2 illustrates the configuration of a control device of the electric water pump shown in FIG. 1.

As shown in FIG. 2, the electric water pump 7 is configured by a water pump body 15 and a brushless motor 16 for driving the water pump body.

The brushless motor 16 used herein is a three-phase brushless motor in which stator windings of U phase, V phase, and W phase are delta connected.

A sensor for detecting the rotation angle of a rotor (not shown in the figure) of the brushless motor 16 is not mounted on the motor. In other words, the brushless motor 16 of the embodiment is of a sensorless type. The rotor of the brushless motor 16 is configured, although not shown in the figure, to rotate integrally with a pump shaft of the water pump body 15.

As shown in FIG. 2, the control device 20 is configured by a driver unit (EDU) 21 of the brushless motor 16 of the electric water pump 7 and an electronic control unit (ECU) 22 for outputting various control instructions to the EDU 21. The two units 21 and 22 are connected to a direct current power source (on-board battery or the like) 23.

As shown in FIG. 2, the EDU 21 is mainly configured by an electrification circuit 25, a motor controller 26, a rotation rate detection circuit 27, an input circuit 28, and an output circuit 29.

The electrification circuit 25 has a configuration with a three-phase bridge connection of switching elements 31, 32, 33, 34, 35, and 36 and is the so-called bipolar drive system. In the embodiment, for example, Metal Oxide Semiconductor (MOS)-type Field Effect Transistors (FET) are used as the switching elements 31 to 36, but any appropriate transistors can be used.

More specifically, the electrification circuit 25 has connected in parallel a serial connection circuit of switching elements 31 and 34, a serial connection circuit of switching elements 32 and 35, and a serial connection circuit of switching elements 33 and 36. One terminal of the electrification circuit is connected to a positive electrode of the direct current power source 23 and the other terminal is connected to a negative electrode or a ground line of the direct current power source 23. Furthermore, the central point of each serial connection circuit is connected to an external connection conductor of the stator windings U, V, and W of the brushless motor 16.

The motor controller 26 is an integrated circuit (IC) for FET control that serves to switch ON-OFF the MOS-type FET that are the switching elements 31 to 36 on the basis of a duty command signal inputted from the ECU 22 via the input circuit 28.

Figures 3A, 3B:
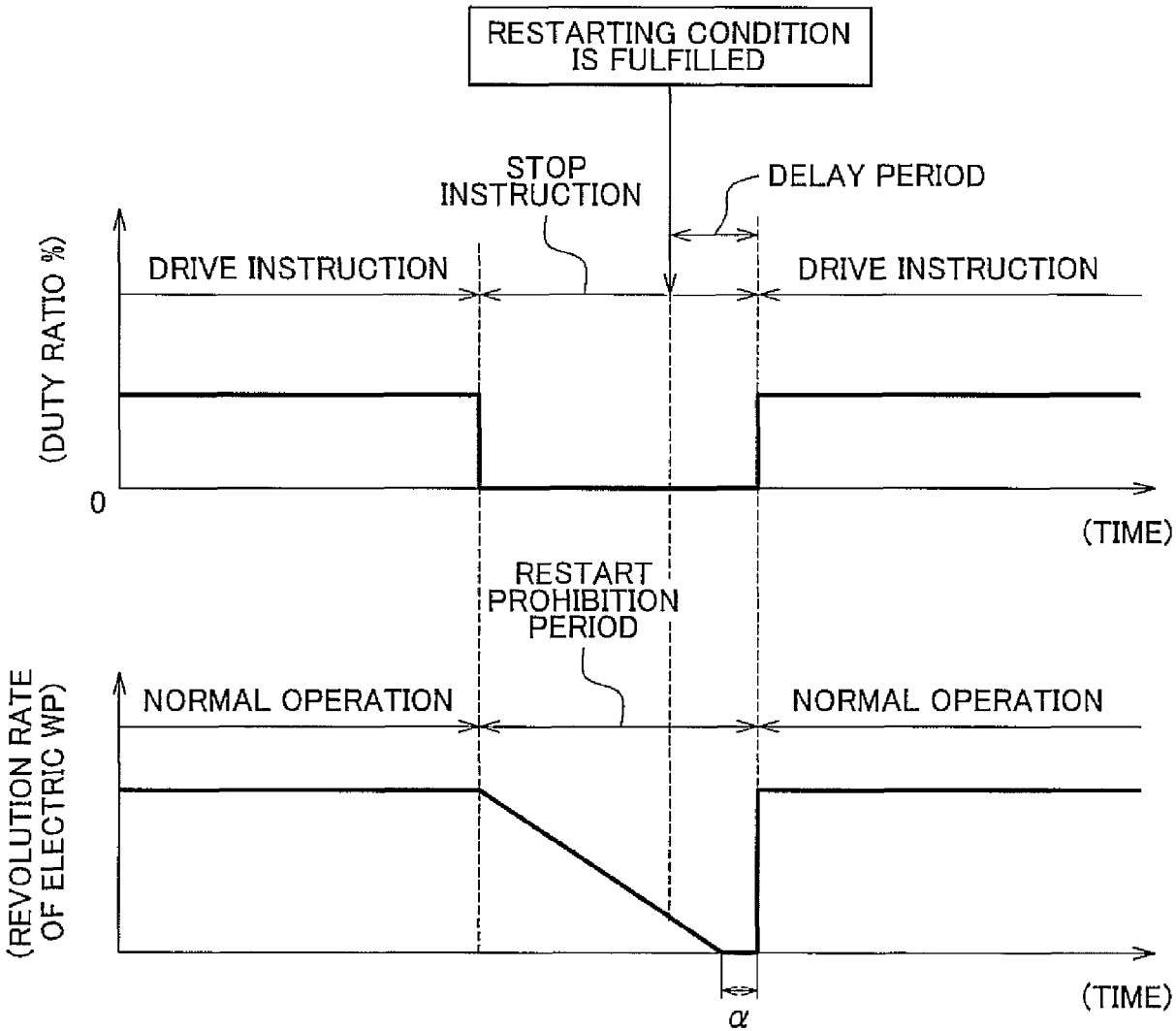
FIGS. 3A and 3B are time charts illustrating how the electric water pump is driven by the control device shown in FIG. 2.

The duty command signal is, for example, as shown in FIG. 3A, a control signal for issuing a drive instruction or stop instruction for the brushless motor 16. This signal is generated by the ECU 22.

The motor controller 26 performs Pulse Width Modulation (PWM) excitation for ON-OFF switching the switching elements 31 to 36 of the electrification circuit 25 in response to the duty command signal inputted from the ECU 22 via the input circuit 28.

The rotation rate detection circuit 27 detects the rotor rotation rate of the brushless motor 16. For example, this circuit converts a counter-electromotive force generated during excitation of the U phase, V phase, and W phase of the brushless motor 16 into a pulse signal and outputs this pulse signal to the ECU 22 via the output circuit 29. The ECU 22 detects a switching period of each phase or rotor rotation rate on the basis of the pulse signal inputted from the rotation rate detection circuit 27.

In the embodiment, the ECU 22 is an external ECU such as an engine electronic control unit (ENG_ECU), rather than an ECU specifically designed for motor control.

The ECU 22 has a configuration constituted by a Central Processing Unit (CPU) that performs control processing and computational processing, a storage device (a memory such as Read Only Memory (ROM), Random Access Memory (RAM), Static Random Access Memory (SRAM), and Electrically Erasable Programmable Read-only Memory (EEPROM)) that stores various programs and data, an input circuit, and an output circuit. The specific configuration of the ECU is not shown in the figures.

By using an external ECU such as an ENG_ECU as the ECU 22, as described hereinabove, control of various types relating to the operation of the internal combustion engine can be performed based on signals (internal combustion engine parameters: signals corresponding to the operation state of occupants and operation state of the internal combustion engine) of various sensors installed at the internal combustion engine.

Among a variety of types of control operations executed by the ECU 22, the control relating to water temperature regulation of the internal combustion engine will be described below.

In the cooling system of the embodiment, the thermostat 10 ensures the warming path X1 through which the coolant passes to the bypass passage 9, without passing through the radiator 8, when the coolant temperature is below the predetermined temperature and ensures the cooling path X2 through which the coolant passes to the radiator 8 when the coolant temperature is equal to or higher than the predetermined temperature. If necessary, the ECU 22 regulates the circulation flow rate of the coolant by driving or stopping the electric water pump 7 via the EDU 21.

More specifically, the ECU 22 determines whether coolant circulation in the cooling system is necessary on the basis of coolant temperature and load acting upon the internal combustion engine, such as the revolution rate of the internal combustion engine or accelerator opening degree, and sends a duty command signal (a drive instruction for driving the brushless motor 16 of the electric water pump 7 or a stop instruction for stopping the brushless motor), for example, such as shown in FIG. 3A, to the EDU 21 correspondingly to the determination result. The EDU 21 performs PWM excitation of the brushless motor 16 in response to the input of the duty command signal.

The control operation of the electric water pump 7 performed by the control device 20 will be explained below in greater detail with reference to a flowchart shown in FIG. 4.

Figure 4:
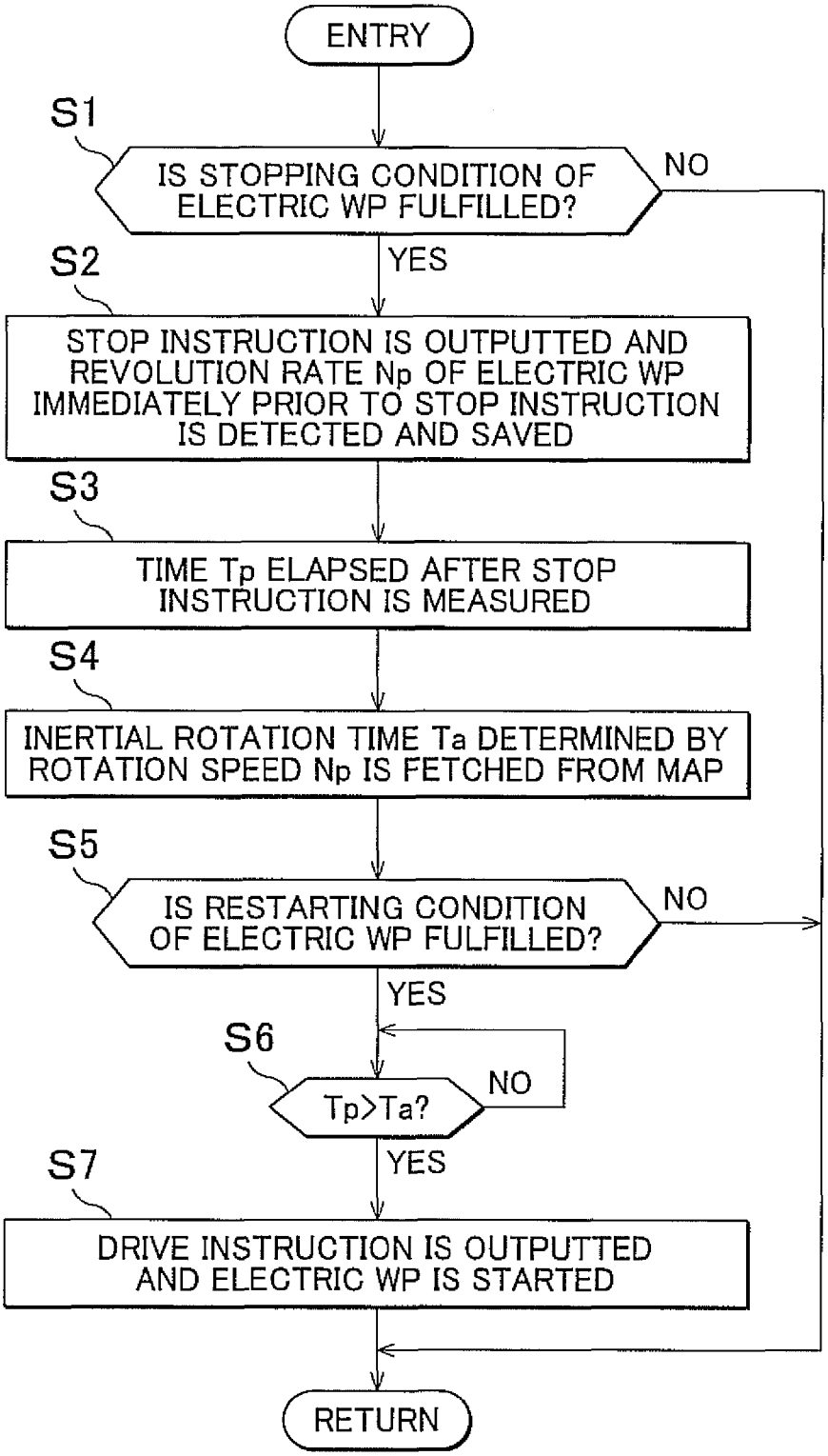
FIG. 4 is a flowchart for explaining a control operation performed by the control device shown in FIG. 2.

The flowchart shown in FIG. 4 mainly represents the operations performed by the ECU 22, and an entry is made for each fixed periodic interval.

In step S1, the ECU 22 determines whether a stopping condition of the electric water pump 7 has been fulfilled. The stopping condition is set based on the coolant temperature and load acting upon the internal combustion engine, such as the revolution rate of the internal combustion engine or accelerator opening degree.

In a case where the stopping condition has not been fulfilled, the ECU 22 makes a negative determination in step S1 and skips the flowchart, but in a case where the stopping condition has been fulfilled, the ECU makes a positive determination in step S1 and moves to the next step S2.

In this step S2, the ECU 22 outputs a duty command signal indicating a stop instruction for the brushless motor 16 and also detects a rotor rotation rate (rotor rotation speed) Np per unit time of the brushless motor 16 when the stop instruction is outputted and saves the detected rotation rate for a certain time.

The stop instruction is a signal indicating a duty ratio of 0% in the duty command signal shown in FIG. 3A. The stop instruction is a signal in excess of a duty ratio of 0% in the duty command signal shown in FIG. 3A.

Then, in step S3, the ECU 22 starts a timer that measures the time Tp that elapsed after the stop instruction, and then in step S4, a standard inertial rotation time Ta corresponding to the rotor rotation rate Np saved in step S2 is read and fetched based on map data that represent the correlation between the rotor rotation rate per unit time and inertial rotation time and were plotted in advance based on test results.

Where the electric water pump 7 is stopped, the rotation speed thereof gradually decreases, while the rotor thereof rotates by inertia, as shown in FIG. 3B. Because the time required for inertial rotation in this case is generally determined by constituent conditions of the brushless motor 16, the map data representing the correlation between the rotor rotation speed and time required for inertial rotation when the electric water pump 7 is stopped can be plotted in advance and saved in the storage device of the ECU 22.

Then, in step S5, the ECU 22 determines whether the restarting condition of the electric water pump 7 is fulfilled.

In a case where the restarting condition is not fulfilled, the ECU 22 makes a negative determination in step S5 and skips the flowchart, but in a case where the restarting condition is fulfilled, the ECU makes a positive determination in step S5 and moves to the next step S6.

In step S6, the ECU 22 determines whether the elapsed time Tp that is a measurement result obtained with the timer started in step S3 is longer than the standard inertial rotation time Ta fetched in step S4.

In a case where the condition Tp>Ta is fulfilled, that is, in a case where the rotor of the brushless motor 16 is estimated to be stopped, the ECU 22 makes a positive determination in step S6 and, in the next step S7, outputs a duty command signal designating a drive instruction to the brushless motor 16, performs electrification of the brushless motor 16 with the EDU 21, and restarts the electric water pump 7. The flowchart is then skipped.

However, where the condition Tp≦Ta is fulfilled, that is, in a case where the rotor of the brushless motor 16 is estimated not to be stopped, the ECU 22 makes a negative determination in step S6 and waits till the conditions of step S6 is fulfilled. Thus, the restart of the electric water pump 7 is prohibited by causing the delay such that the transition to step S7 is not made till the condition of step S6 is satisfied.

In the explanation of operations hereinabove, the standard inertial rotation time Ta used in the map data corresponds to the restart prohibition period shown in FIG. 3B. However, a state in which the rotor is completely stopped may be reliably estimated by setting a value obtained by adding an appropriate margin time α shown in FIG. 3B to the actually obtained inertial rotation time as the standard inertial rotation time Ta. It goes without saying, that the margin time α may be omitted.

In the above-described embodiment, the EDU 21 functions as a drive unit in accordance with the invention, and the ECU 22 functions as sections of the drive unit in accordance with the invention.

As described hereinabove, in the embodiment using the specific features of the invention, the electric water pump 7 is not restarted till the rotor stops rotating, even when the restarting condition is satisfied while the rotor of the sensor-less-type brushless motor 16 provided in the electric water pump 7 rotates by inertia.

As a result, it is possible to avoid peculiar inconveniences that can occur in a case where a sensorless-type brushless motor 16 is used to reduce cost and size, namely, to avoid a phenomenon of loss of synchronization occurring when the brushless motor 16 is restarted when the rotor thereof rotates by inertia.

Therefore, by contrast with a case where loss of synchronization of the brushless motor has occurred, a recovery processing after loss of synchronization becomes unnecessary. As a consequence, the time that is required to elapse from when the restarting condition is fulfilled till when the start is actually performed can be shortened and, therefore, temperature regulation of the coolant by coolant circulation in the coolant system can be performed with good stability.

In the above-described embodiment, an example is explained in which in order to detect that the rotor stopped after the instruction to stop the brushless motor 16 has been outputted, the estimation is carried out by using map data representing a relationship between a rotor rotation rate per unit time when the stop instruction is outputted and the inertial rotation time, but a configuration may be also used in which the rotor stop is detected, for example, by examining the pressure of the coolant discharge side of the water pump body 15.

Figure 5:
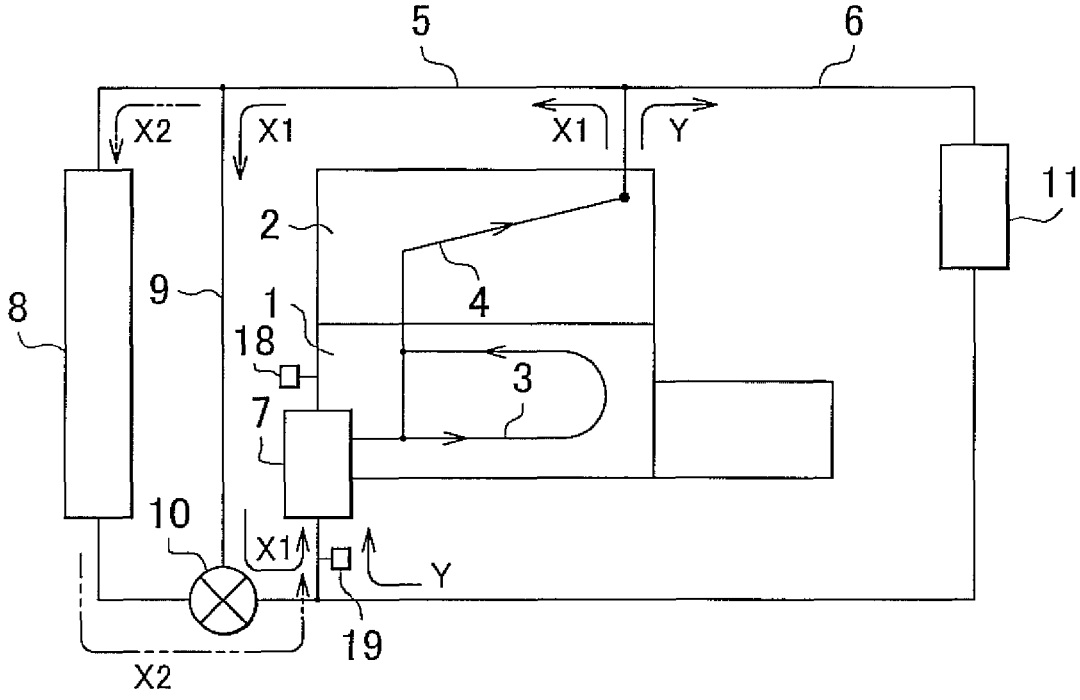
FIG. 5 is a schematic structural diagram illustrating a cooling system of an internal combustion engine of a modification example of the embodiment of the invention.

In this case, respective pressure sensors 18 and 19 are provided on the coolant discharge side and coolant introduction side of the electric water pump 7, for example, as in the cooling system shown in FIG. 5.

Figure 6:
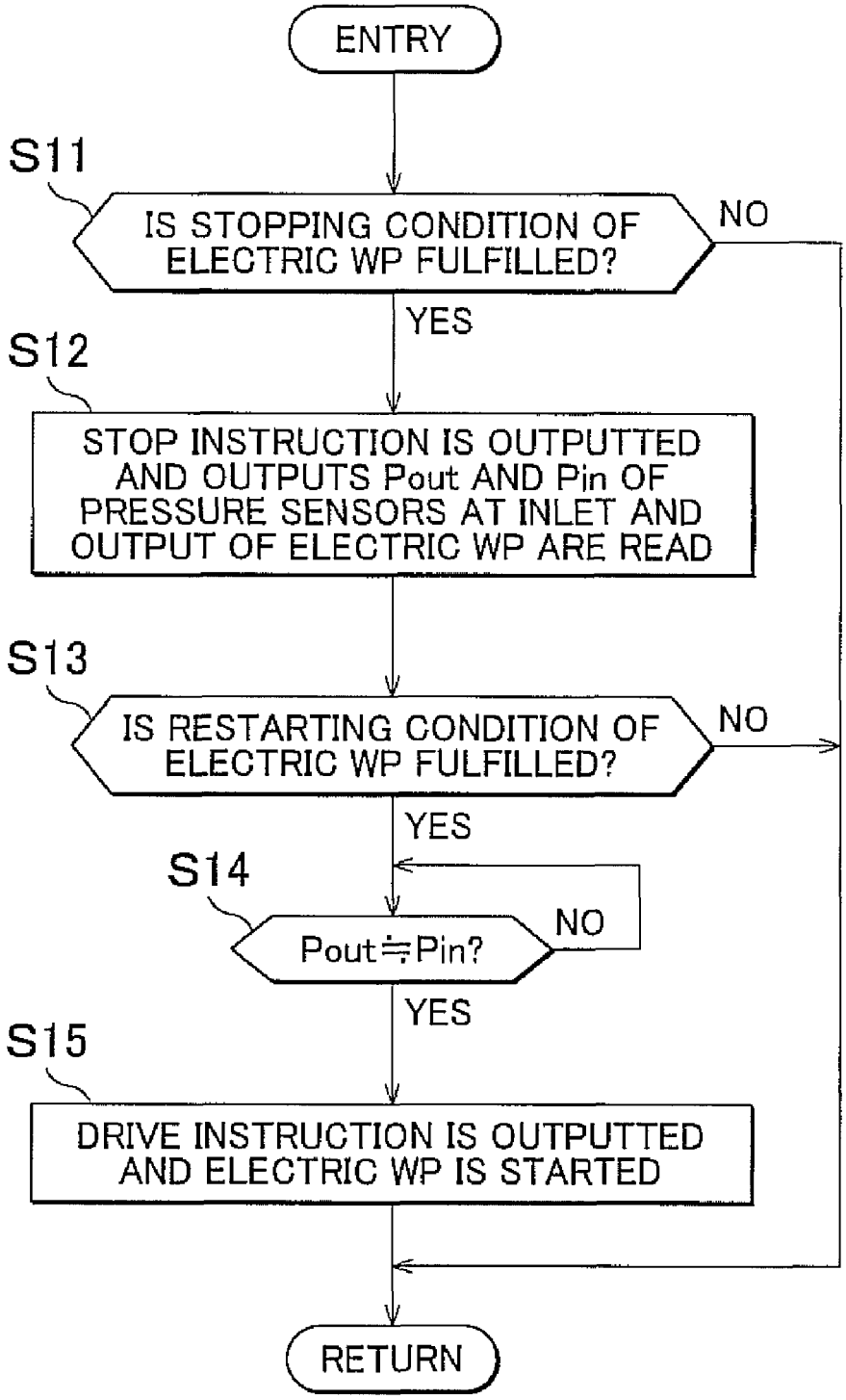
FIG. 6 is a flowchart for explaining a control operation performed by the control device of the modification example of the embodiment of the invention.

The ECU 22 determines whether the stopping condition of the electric water pump 7 is fulfilled in step S11, for example, as in the flowchart shown in FIG. 6.

In the flowchart shown in FIG. 6, an entry is made per each fixed periodic interval. First, the above-described stopping condition is set on the basis of coolant temperature and load acting upon the internal combustion engine, such as the revolution rate of the internal combustion engine or accelerator opening degree.

In a case where the stopping condition is not fulfilled, a negative determination is made in step S11 and the flowchart is skipped, but in a case where the stopping condition is fulfilled, a positive determination is made in step S11 and the processing advances to the next step S12.

In this step S12, a duty command signal indicating a stop instruction for the brushless motor 16 is outputted, pressures Pout and Pin on the coolant discharge side and coolant introduction side of the electric water pump 7 are detected on the basis of output from the pressure sensors 18 and 19 obtained when the stop instruction is outputted, and the detected pressures are temporarily saved.

In the next step S13, it is determined whether the restarting condition of the electric water pump 7 is fulfilled, In a case where the restarting condition is not fulfilled, a negative determination is made in step S13 and the flowchart is skipped, but in a case where the restating condition is fulfilled, a positive determination is made in step S13 and the processing advances to the next step S14.

In step S14, it is determined whether the actual pressure Pout on the coolant discharge side that has been measured in step S12 is substantially equal to the pressure Pin on the coolant introduction side. In other words, it is investigated whether the pressure Pout on the coolant discharge side is within an allowed range obtained by adding predetermined positive and negative margins to the Pin on the coolant introduction side.

In a case where a condition of Pout≅Pin is fulfilled, that is, in a case where it is determined that the rotor of the brushless motor 16 is stopped, a positive determination is made in step S14, and in the next step S15, a duty command signal indicating a drive instruction for the brushless motor 16 is outputted, the brushless motor 16 is energized by the EDU 21, and the electric water pump 7 is restarted and the flowchart is skipped.

However, in a case where the condition of Pout≅Pin is not fulfilled, that is, in a case where it is determined that the rotor of the brushless motor 16 is not stopped, a negative determination is made in step S14, and the system waits till the condition of step S14 is fulfilled. Thus, the processing does not advance to step S15 till the condition of step S14 is fulfilled, whereby the restart of the electric water pump 7 is prohibited.

In this embodiment, similarly to the above-described embodiment, it is possible to avoid a phenomenon of loss of synchronization occurring when the brushless motor 16 is restarted after being stopped.

In this embodiment, an example is described in which the system waits till the rotor stops by itself after the stopping instruction has been outputted for the brushless motor 16, but the invention is not limited to this configuration and it is possible to add a processing, for example, such that applies a brake force to the rotor and forcibly stops the rotor, to the above-described embodiment.

As a first variation example, a configuration can be considered in which only one phase of a three-phase brushless motor serving as the brushless motor 16 is continuously energized when the stopping condition of the brushless motor 16 is fulfilled.

More specifically, when the stopping condition is fulfilled, the ECU 22 generates a duty command signal serving as a drive instruction for performing continuous energizing of only one phase of the three-phase brushless motor and outputs the generated duty command signal to the EDU 21. The EDU 21 functions to perform continuous energizing of only one phase of the three-phase brushless motor on the basis of the inputted duty command signal.

In this case, a magnetic force generated in a stator winding of one phase that is the electrification object draws in and restrains the magnet of the rotor of the brushless motor 16. As a result, this restraining force becomes the rotation resistance for the rotor and applies a brake force to the rotor.

Figures 7A, 7B:
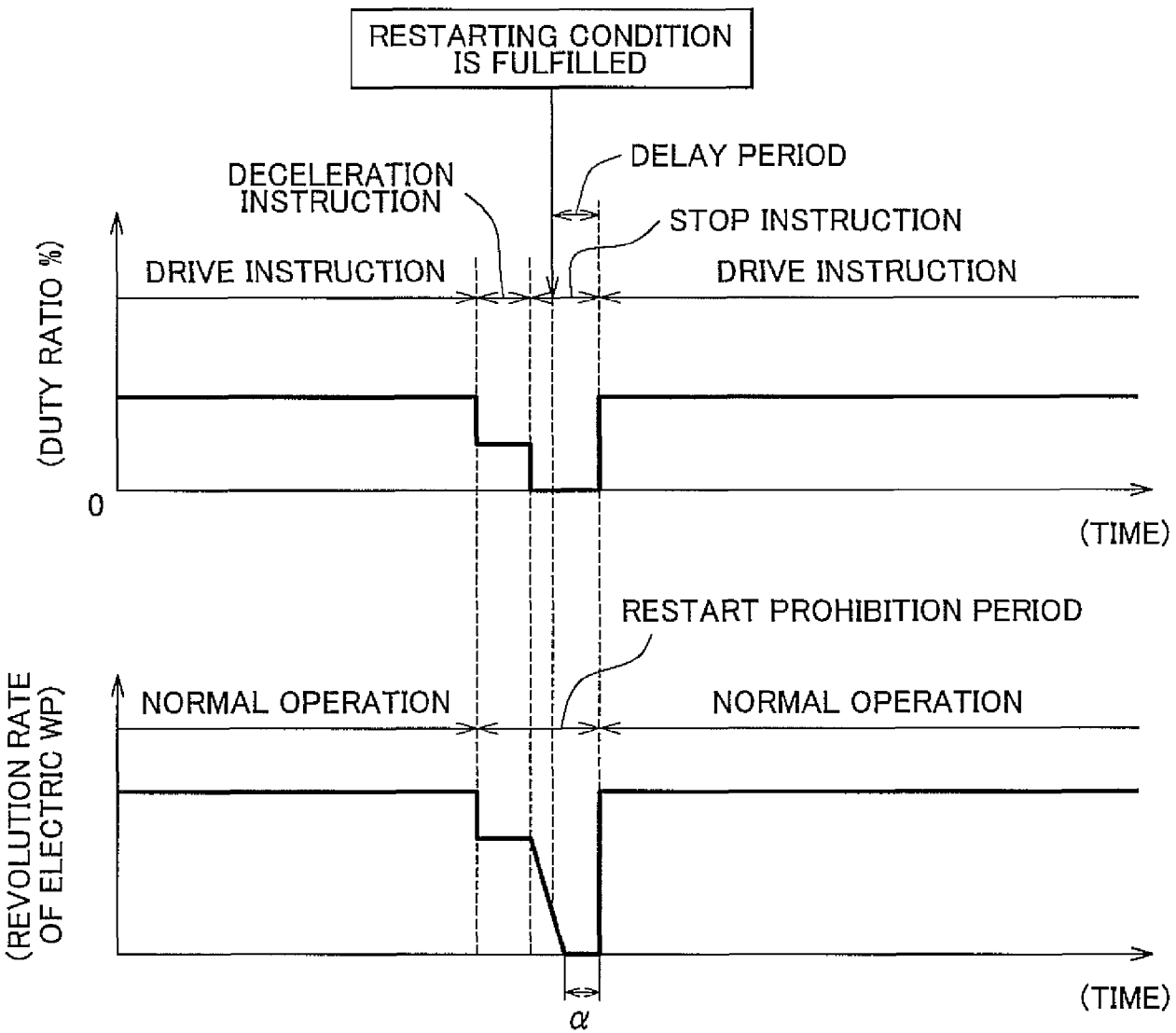
FIGS. 7A and 7B time charts illustrating how the electric water pump is driven by the control device of the modification example of the embodiment of the invention.

As a second variation example, a mode can be used in which the ECU 22 outputs a deceleration instruction that has a duty ratio lower than that of the usual drive instruction when the stopping condition of the brushless motor 16 is fulfilled, for example, in the time chart shown in FIG. 7A, and then outputs the stopping instruction.

In this case, as shown in FIG. 7B, the rotation rate of the electric water pump 7, that is, the rotation rate of the brushless motor 16 decreases in a stepwise manner and a brake force is applied to the rotor.

In this case, the period from when the stopping condition is fulfilled to when the drive instruction is outputted corresponds to the restart prohibition period shown in FIG. 7B. As shown in FIG. 7B, the drive instruction is outputted when an appropriate margin time $\alpha$ elapses since the rotor was determined to stop rotating on the basis, for ex maple, of the output of the rotation rate detection circuit 27 of the EDU 21.

In all these variation examples, the inertial rotation time after the electric water pump 7 has been stopped can be also shortened. As a result, the period in which the restart is prohibited (or the delay period) can be shortened and the time that is required to elapse till when the start is actually performed can be shortened, for example, even when the restarting condition is fulfilled during inertial rotation.

In the second variation example, an example is described in which a control mode of the brushless motor 16 is implemented as a means for applying a brake force to the rotor, but the invention is not limited to this configuration, and it is also possible, for example, to provide an electric flow rate control valve on the coolant introduction side of the electric water pump 7 and reduce the opening degree of the electric flow rate control valve or completely close the valve when a stop instruction for the brushless motor 16 is received (this configuration is not shown in the figure).

In this case, where the opening degree of the electric flow rate control valve is reduced or the valve is completely closed, an inertia force created by the coolant does not act upon a fin (not shown in the figure) provided at a pump shaft (not shown in the figure) of the water pump body 15. Therefore, a brake force is applied to the rotor of the brushless motor 16 that is integrated with the pump shaft.

In this configuration, the inertial rotation time after the electric water pump 7 has been stopped can be also shortened. As a result, the period in which the restart is prohibited (or the delay period) can be shortened and the time that is required to elapse till when the start is actually performed can be shortened, for example, even when the restarting condition is fulfilled during inertial rotation.

In the above-described embodiments, an example is described that relates to a configuration in which the bypass passage 9 is provided, as shown in FIG. 1, in the cooling system in which the electric water pump 7 in accordance with the invention is to be used, but the invention is not limited to this configuration and may be implemented without using the bypass passage 9. Furthermore, an electric opening-closing valve or an electric flow rate control valve may be used instead of the thermostat 10 shown in FIG. 1.

In the above-described embodiments, a three-phase brushless motor with delta connection is described as the brushless motor 16 by way of example, but the invention is not limited to such a brushless motor and may be implemented, for example, with a star connection.

Furthermore, the sensorless-type brushless motor in accordance with the invention is a brushless motor from which magnetic sensors for detecting a position (angle) of the brushless motor rotor have been removed.

For example, an electric opening-closing valve or an electric flow rate control valve for limiting the amount of coolant introduced in the electric water pump may be used as the braking unit in accordance with the invention. Where the opening degree of these valves is reduced or the valves are completely closed, an inertia force created by the coolant does not act upon the fin provided at the pump shaft of the water pump. Therefore, a brake force is applied to the rotor of the brushless motor that is integrated with the pump shaft.

While some embodiments of the invention have been illustrated above, it is to be understood that the invention is not limited to details of the illustrated embodiments, but may be embodied with various changes, modifications or improvements, which may occur to those skilled in the art, without departing from the spirit and scope of the invention.

In summary, the present invention relates to a control system including an electric water pump that has a sensorless-type brushless motor including a rotor that rotates so as to circulate a coolant between an internal combustion engine and a radiator; and a control device that issues an instruction to stop the brushless motor and prohibits a start of the brushless motor from when the stop instruction is outputted till when the rotor stops rotating.

In addition, the control device may perform control of applying a brake force to the rotor when the instruction to stop the brushless motor is outputted.

With the feature, the revolution rate of the rotor that rotates by inertia is forcibly decreased and, therefore, the time from when the instruction to stop the brushless motor is outputted till when the rotor stops rotating can be shortened.

In the control system, the control device may prohibit a start of the brushless motor till the rotor stops rotating, when a condition for restarting the brushless motor is fulfilled during inertial rotation from when the stop instruction is outputted till when the rotation of the rotor is stopped.

In the control system, the control device may include a signal output unit that outputs command signal for driving or stopping the brushless motor, as need arises; a drive unit that performs electrification or stops electrification of the brushless motor in response to the command signal from the signal output unit; and a management unit that prohibits the output of the command signal for driving from the signal output unit, from when the command signal for stopping is outputted from the signal output unit till when the rotor stops rotating.

With the feature, it is possible to avoid peculiar inconveniences that can occur in a case where a sensorless-type brushless motor is used as a motor for an electric water pump to make the pump less expensive and more compact, namely, to avoid a phenomenon of loss of synchronization occurring when the brushless motor is restarted when the rotor thereof rotates by inertia.

In other words, a restart processing is not executed till when the rotor stops rotating, even if the restarting condition is fulfilled while the rotor of the sensorless-type brushless motor provided in the electric water pump rotates by inertia. As a result, no loss of synchronization occurs in the brushless motor.

Therefore, by contrast with a case where loss of synchronization of the brushless motor has occurred, a recovery processing after loss of synchronization becomes unnecessary. As a consequence, the time that is required to elapse from when the restarting condition is fulfilled till when the start is actually performed can be shortened and, therefore, temperature regulation of the coolant by coolant circulation can be performed with good stability.

In the control system, the control device may further include a rotation stop estimation unit that estimates a time in which the rotor rotates by inertia, on the basis of a rotation speed of the rotor at the time the command signal for stopping is outputted; and the management unit may prohibit the output of the command signal for driving the brushless motor from the signal output unit, from when the command signal for stopping is outputted from the signal output unit till when the time, in which the rotor rotates by inertia, elapses.

In the control system, the control device may store a map that has established in advance a relationship between a rotor rotation rate during the stop and a time, during which the rotor rotates by inertia; and the rotation stop estimation unit may estimate a time, during which the rotor rotates by inertia, on the basis of the rotor rotation rate during output of the command signal for stopping according to the map.

With the feature, tools for estimating the rotor rotation stop is specified as a control program using map data that represent a correlation between the rotor rotation rate and inertial rotation time. Such specification is advantageous because the configuration can be simplified; no special equipment has to be added.

In the control system, the control device may further include a rotation stop detection unit that detects a rotation stop of the rotor, on the basis of a pressure on a discharge side of the electric water pump; and the management unit may prohibit the output of the command signal for driving the brushless motor from the signal output unit, from when the command signal for stopping is outputted from the signal output unit till when the rotation stop of the rotor is detected.

With the feature, tools for detecting the rotation stop of the rotor is specified to use an output of a pressure sensor that is typically provided in a cooling system of an internal combustion engine. Such specification is advantageous because the configuration can be simplified; no special equipment has to be added.

In the control system, the brushless motor may be a three-phase brushless motor; and the management unit may cause the signal output unit to output a signal for performing electrification of only one phase of the brushless motor when a condition for stopping the brushless motor is fulfilled.

With the feature, a magnetic force generated in a stator winding of one phase that is the electrification object draws in and restrains the magnet of the brushless motor rotor. As a result, this restraining force becomes the rotation resistance for the rotor and applies a brake force to the rotor.

As a consequence, the rotation rate of the rotor that rotates by inertia is forcibly decreased and the time from when the stopping conditions of the brushless motor is fulfilled till when the rotor stops rotating can be shortened.

In the control system, the brushless motor may be a three-phase brushless motor; the signal output unit may output a duty command signal that is an instruction signal for driving or stopping the brushless motor; and the management unit may cause the signal output unit to output the command signal for stopping after outputting a deceleration command signal that has a duty ratio lower than that of the command signal for driving and higher than that of the command signal for stopping, when a condition for stopping the brushless motor is fulfilled.

In this case, where a deceleration instruction outputted from the signal output unit is received by the drive unit, the drive unit performs electrification corresponding to the deceleration instruction with respect to the stator winding of the brushless motor, whereby the rotation rate of the rotor is reduced.

By outputting the stop instruction after the deceleration instruction, it is possible to shorten the inertial rotation time of the rotor after the stop instruction. As a result, the time from when the stopping condition of the brushless motor is fulfilled till when the rotor stops rotating can be shortened.

The control system may further include a brake unit that applies a brake force to the rotor, wherein the management unit may cause the brake unit to apply the brake force and may cause the signal output unit to output a command signal for stopping the brushless motor when a stopping condition that is a condition for stopping the brushless motor is fulfilled.

With the feature, the revolution rate of the rotor that rotates by inertia is forcibly decreased and, therefore, the time from when the instruction to stop the brushless motor is outputted till when the rotor stops rotating can be shortened.

In the control system, the management unit may determine whether the stopping condition or a restarting condition that is a condition for restarting the brushless motor is fulfilled and also may control an output timing of the command signal outputted by the signal output unit, on the basis of a load of the internal combustion engine or a temperature of the coolant.

With the feature, a trigger condition for starting or stopping the electric water pump is specified.

In the control system, the management unit may prohibit the output of the command signal for driving from the signal output unit till the rotor stops rotating, when a condition for starting the brushless motor is fulfilled during inertial rotation from when the command signal for stopping is outputted from the signal output unit till when the rotor of the brushless motor stops rotating.

In summary, the present invention also relates to a method for controlling an electric water pump that has a sensorless-type brushless motor including a rotor that rotates so as to circulate a coolant between an internal combustion engine and a radiator. The control method includes: stopping the brushless motor; estimating a time, during which the rotor rotates by inertia, on the basis of a rotation speed of the rotor when the brushless motor is stopped; and prohibiting a start of the brushless motor from when the brushless motor is stopped till when the estimated time, during which the rotor rotates by inertia, elapses.

In addition, the control method may be repeated at fixed periodic intervals.

Furthermore, in accordance with the invention, the time that is required to elapse from when the stop instruction for the brushless motor is outputted till when the restart is actually performed can be shortened. Therefore, temperature regulation of the coolant in the internal combustion engine can be performed with good stability. As a result, contribution is made to reliability improvement of the cooling system.

What is claimed is:

1. A control system, comprising:

an electric water pump that has a sensorless-type brushless motor including a rotor that rotates so as to circulate a coolant between an internal combustion engine and a radiator; and a control device that issues an instruction to stop the brushless motor and prohibits a start of the brushless motor from when the stop instruction is outputted till when the rotor stops rotating.

2. The control system according to claim 1, wherein the control device performs control of applying a brake force to the rotor when the instruction to stop the brushless motor is outputted.

3. The control system according to claim 1, wherein the control device prohibits a start of the brushless motor till the rotor stops rotating, when a condition for restarting the brushless motor is fullfilled during inertial rotation from when the stop instruction is outputted till when the rotation of the rotor is stopped.

4. The control system according to claim 1, wherein the control device includes:

a signal output unit that outputs a command signal for driving or stopping the brushless motor;

a drive unit that performs electrification or stops electrification of the brushless motor in response to the command signal from the signal output unit; and a management unit that prohibits the output of the command signal for driving from the signal output unit, from when the command signal for stopping is outputted from the signal output unit till when the rotor stops rotating.

5. The control system according to claim 4, wherein the control device further comprises a rotation stop estimation unit that estimates a time in which the rotor rotates by inertia, on the basis of a rotation speed of the rotor at the time the command signal for stopping is outputted, and the management unit prohibits the output of the command signal for driving the brushless motor from the signal output unit, from when the command signal for stopping is outputted from the signal output unit till when the time, in which the rotor rotates by inertia, elapses.

6. The control system according to claim 4, wherein the control device further comprises a rotation stop detection unit that detects a rotation stop of the rotor, on the basis of a pressure on a discharge side of the electric water pump, and the management unit prohibits the output of the command signal for driving the brushless motor from the signal output unit, from when the command signal for stopping is outputted from the signal output unit till when the rotation stop of the rotor is detected.

7. The control system according to claim 4, wherein:

the brushless motor is a three-phase brushless motor; and the management unit causes the signal output unit to output a signal for performing electrification of only one phase of the brushless motor when a condition for stopping the brushless motor is fulfilled.

8. The control system according to claim 4, wherein:

the brushless motor is a three-phase brushless motor;

the signal output unit outputs a duty command signal that is an instruction signal for driving or stopping the brushless motor; and the management unit causes the signal output unit to output the command signal for stopping after outputting a deceleration command signal that has a duty ratio lower than that of the command signal for driving and higher than that of the command signal for stopping, when a condition for stopping the brushless motor is fulfilled.

9. The control system according to claim 4, further comprising a brake unit that applies a brake force to the rotor, wherein the management unit causes the brake unit to apply the brake force and causes the signal output unit to output a command signal for stopping the brushless motor when a stopping condition that is a condition for stopping the brushless motor is fulfilled.

10. The control system according to claim 4, wherein the management unit determines whether the stopping condition or a restarting condition that is a condition for restarting the brushless motor is fulfilled and also controls an output timing of the command signal outputted by the signal output unit, on the basis of a load of the internal combustion engine or a temperature of the coolant.

11. The control system according to claim 4, wherein the management unit prohibits the output of the command signal for driving from the signal output unit till the rotor stops rotating, when a condition for starting the brushless motor is fulfilled during inertial rotation from when the command signal for stopping is outputted from the signal output unit till when the rotor of the brushless motor stops rotating.

12. The control system according to claim 5, wherein the control device stores a map that has established in advance a relationship between a rotor rotation rate during the stop and a time, during which the rotor rotates by inertia; and the rotation stop estimation unit estimates a time, during which the rotor rotates by inertia, on the basis of the rotor rotation rate during output of the command signal for stopping according to the map.

13. A method for controlling an electric water pump that has a sensorless-type brushless motor including a rotor that rotates so as to circulate a coolant between an internal combustion engine and a radiator, the method comprising:

stopping the brushless motor;

estimating a time, during which the rotor rotates by inertia, on the basis of a rotation speed of the rotor when the brushless motor is stopped; and prohibiting a start of the brushless motor from when the brushless motor is stopped till when the estimated time, during which the rotor rotates by inertia, elapses.

14. The control method according to claim 13 is repeated at fixed periodic intervals.

15. An electric water pump control system, comprising:

an electric water pump that has a sensorless-type brushless motor including a rotor that rotates so as to circulate a coolant between an internal combustion engine and a radiator;

signal output means for outputting a command signal for driving or stopping the brushless motor;

drive means for performing electrification or stopping the electrification of the brushless motor in response to the command signal from the signal output means; and management means for prohibiting the output of the command signal for driving the brushless motor from the signal output means, from when the command signal for stopping is outputted from the signal output means till when the rotor stops rotating.

* * * * *